US006155697A

United States Patent [19]

Ahroni

[11] Patent Number: 6,155,697

[45] Date of Patent: Dec. 5, 2000

[54] DRAPING DECORATIVE LIGHT STRING

[76] Inventor: Joseph M. Ahroni, 2701 W. Manor Pl., No. 204, Seattle, Wash. 98199

[21] Appl. No.: 09/237,200

[22] Filed: Jan. 25, 1999

[51] Int. Cl.[7] ..... F21S 4/00; F21V 21/008

[52] U.S. Cl. ..... 362/252; 362/391; 362/806

[58] Field of Search ..... 362/123, 227, 362/249, 250, 252, 391, 806, 807

[56] References Cited

U.S. PATENT DOCUMENTS

| | | | |
|---|---|---|---|
| 1,640,282 | 8/1927 | Migliaccio | 362/252 |
| 4,720,773 | 1/1988 | Ahroni | 362/249 |
| 5,025,357 | 6/1991 | Maurer | 362/249 |
| 5,150,964 | 9/1992 | Tsui | 362/252 |
| 5,667,295 | 9/1997 | Tsui | 362/252 |
| 5,712,002 | 1/1998 | Reilly, III | 362/123 |
| 5,915,827 | 6/1999 | Wang | 362/252 |
| 6,050,701 | 4/2000 | Stone | 362/249 |

*Primary Examiner*—Alan Cariaso
*Attorney, Agent, or Firm*—Seed IP Law Group PLLC

[57] ABSTRACT

A light string is configured by clips in multiple draping sections in progressively longer arcs which are vertically spaced apart and are spaced by connecting sections. The connection sections are normally mounted in horizontal aligned positions by the use of hooks or other mounting elements provided by the clips.

14 Claims, 7 Drawing Sheets

DRAPING DECORATIVE LIGHT STRING

TECHNICAL FIELD

The present invention relates to decorative light sets such as those with push-in type miniature bulb units, and more particularly to a system for attractively draping a string of lights.

BACKGROUND OF THE INVENTION

In my prior U.S. Pat. No. 4,720,773 there is shown a string of lights draping in a series of loops from tabs formed in a strap which may be mounted as a collar at the top of a Christmas tree so that the loops drape from the collar over the length of the tree. The strap may also be mounted in a straight line, for example, on an eave or other structure resulting in a horizontal series of side-by-side draping loops. My later U.S. Pat. No. 4,736,282 shows a different tree collar for draping loops of a light string having a 3-wire cord.

SUMMARY OF THE INVENTION

The present invention aims to provide an alternative draping configuration for decorative light sets and manner of mounting them.

By the present invention a light string is configured in multiple draping sections in progressively longer arcs which are vertically spaced apart. This is accomplished by the use of novel clips which divide a light string in draping sections separated by connecting sections which are normally mounted horizontally by the aid of mounting elements provided by the clips.

DETAILED DESCRIPTION OF THE INVENTION

Figure 1A:
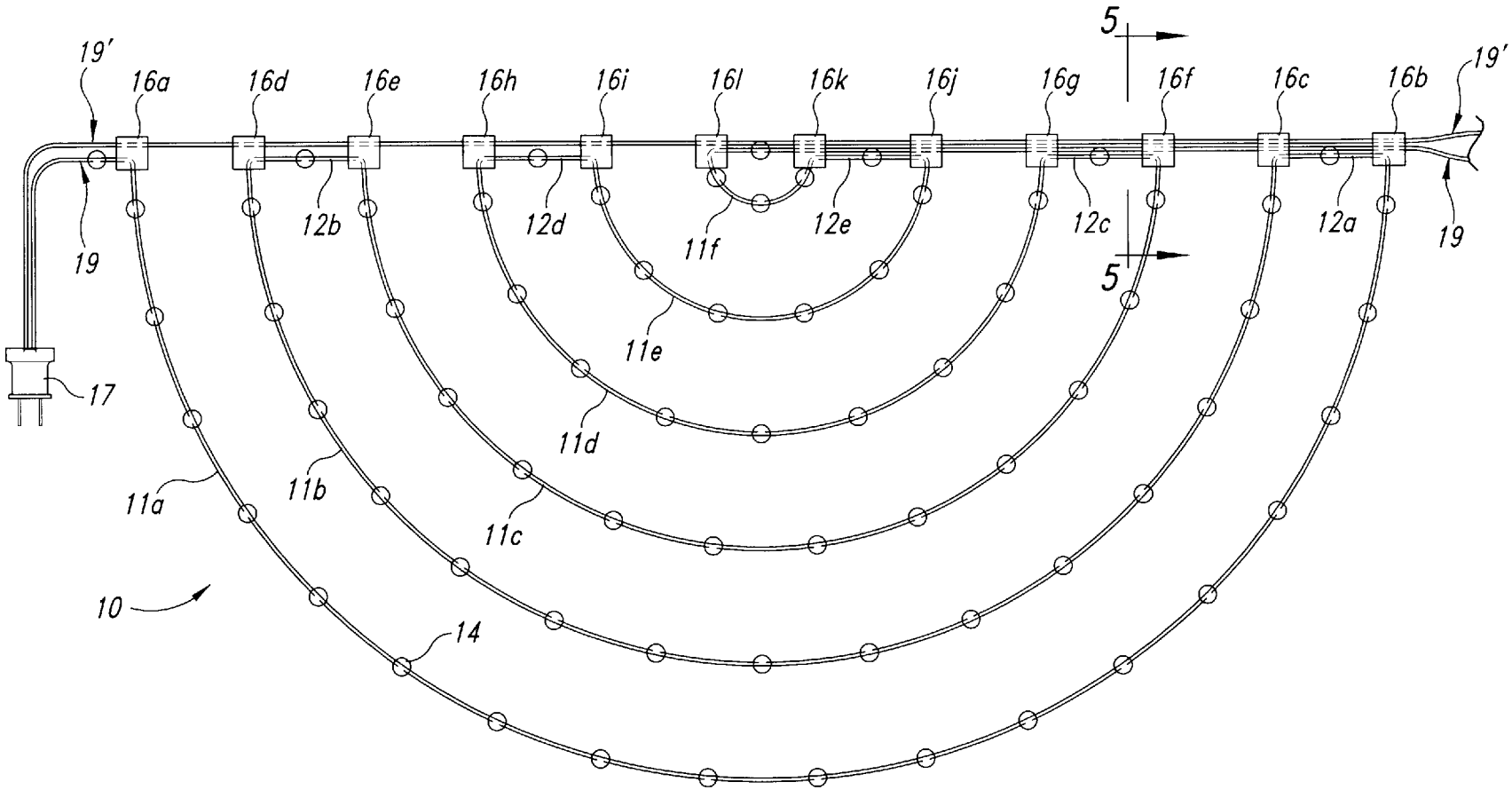
FIGS. 1A and 1B show the layout of dual strings of lights formed into multiple draping sections by the use of clips in accordance with the present invention.

Referring to FIG. 1A, it is seen that a string 10 of lights is arranged so that there are a plurality of draping sections 11*a*–11*f* which drape in vertically spaced arcs from aligned connecting sections 12*a*–12*e*. For purposes of example the string 10 is shown as having six draping sections and five connecting sections. Light units 14 are provided, preferably at regular intervals, on each draping section, and one or more light units may also be provided on the connecting sections.

To maintain the light string in the draping configuration a plurality of clips 16 is provided, one for each intersection of a draping section with a connecting section, plus one clip for one end of the longest draping section and the shortest draping section. As will later be discussed, the clips are adapted to be mounted in selected manners.

The wires for the string 10 are preferably provided by a cord 19 of the type having two parallel insulated wires 19*a*–19*b* having their insulation 19*c* joined between the wires. The cord can also consist, for example, of two insulated wires which are wound together. The light units 14 can be of the push-in type shown, fore example, in U.S. Pat. Nos. 4,631,650 and 4,779,177, and 5,154,508, but having two rather than three wires in the cord.

Figure 1B:
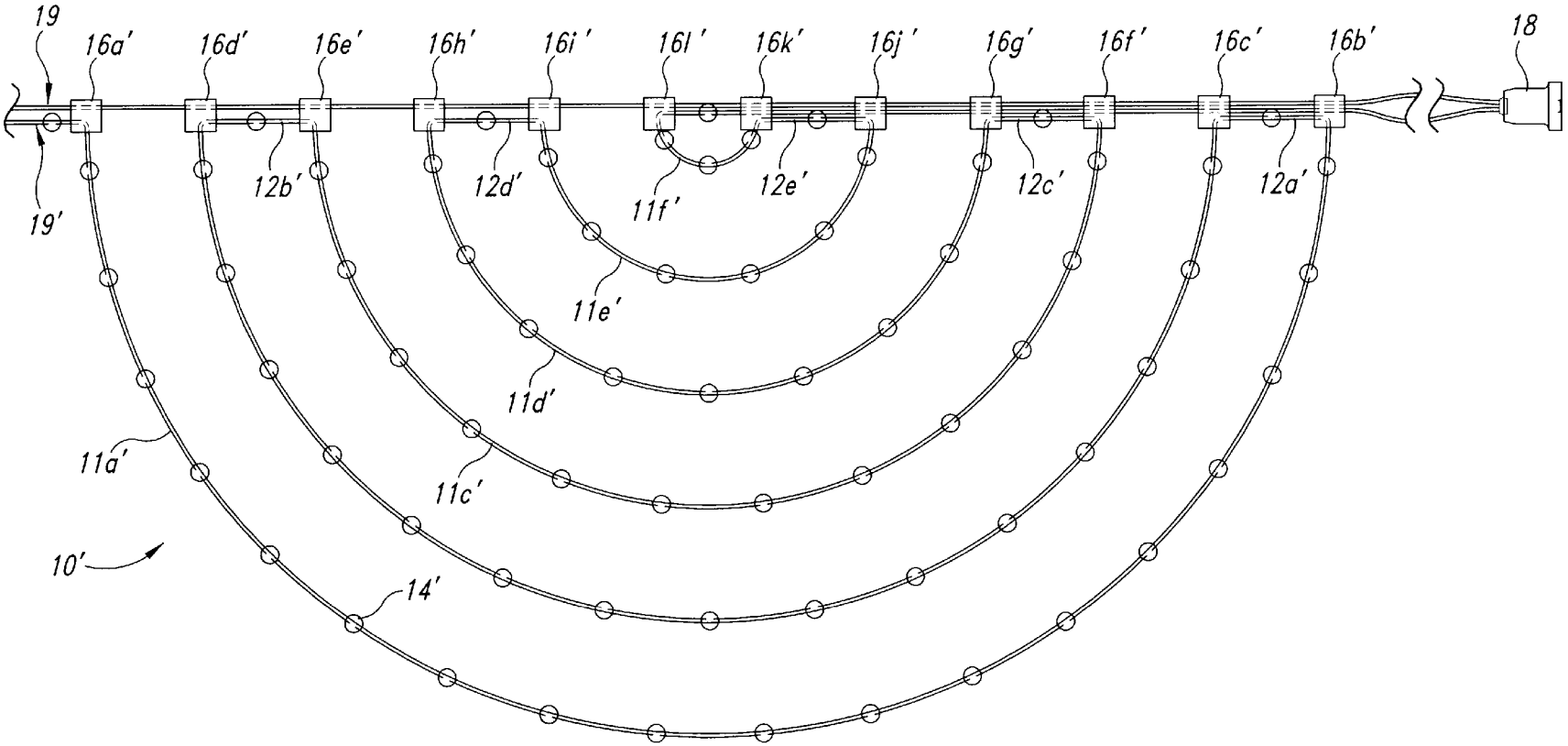
Figure 2:
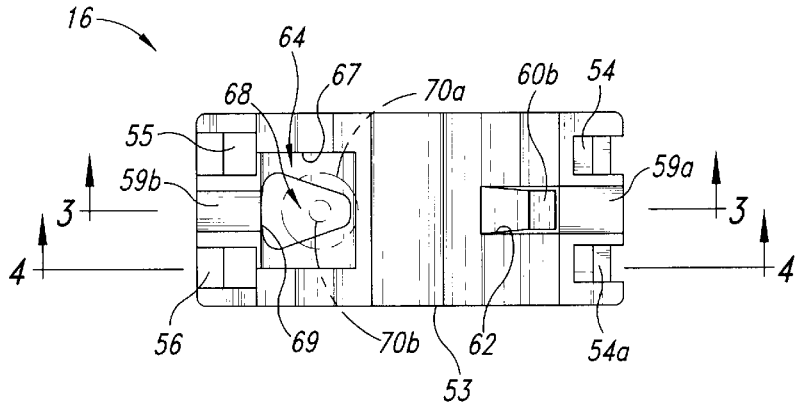
FIG. 2 is a plan view of one of the clips before it is closed.
Figure 3:
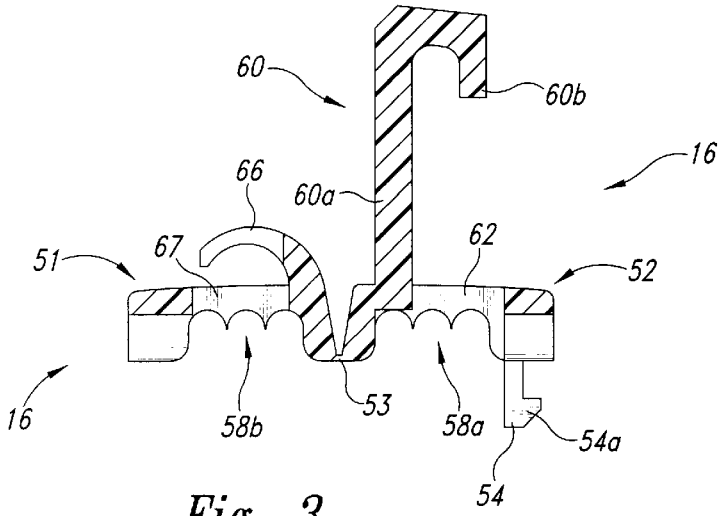
FIG. 3 is a sectional view through the clip taken as indicated by line 3—3 of FIG. 2.
Figure 4:
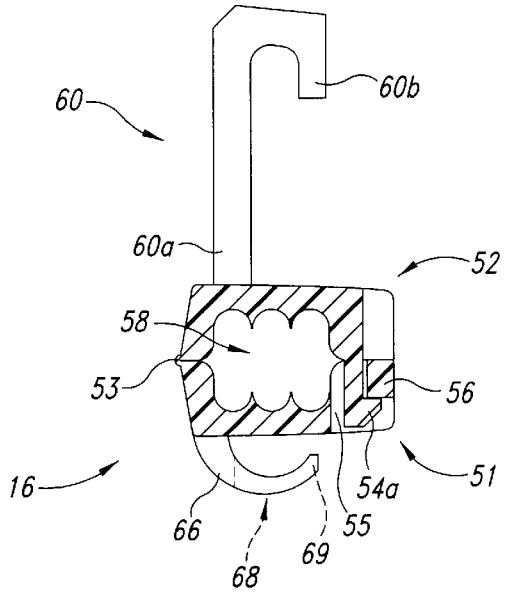
FIG. 4 is a sectional view through the clip taken as indicated by line 4—4 of FIG. 2, but with the clip closed.

The cord 19 is connected to a wall plug 17 at one end and to an add-on plug 18 at the opposite end. Preferably a second string 10 of lights is arranged in the same draping fashion as the string 10 to occupy a position next to the string 10. This second string is shown in FIG. 1B and is marked in the same manner as the first string, but with the reference numerals followed by a prime. The cord 19' for the second string 10' is preferably also connected to the plug 17 and add-on plug 18. In this arrangement each of the two blades of the plug 17 and of the two internal contacts of the plug 18 has a wire from each cord 19–19' connected thereto.

Figure 8:
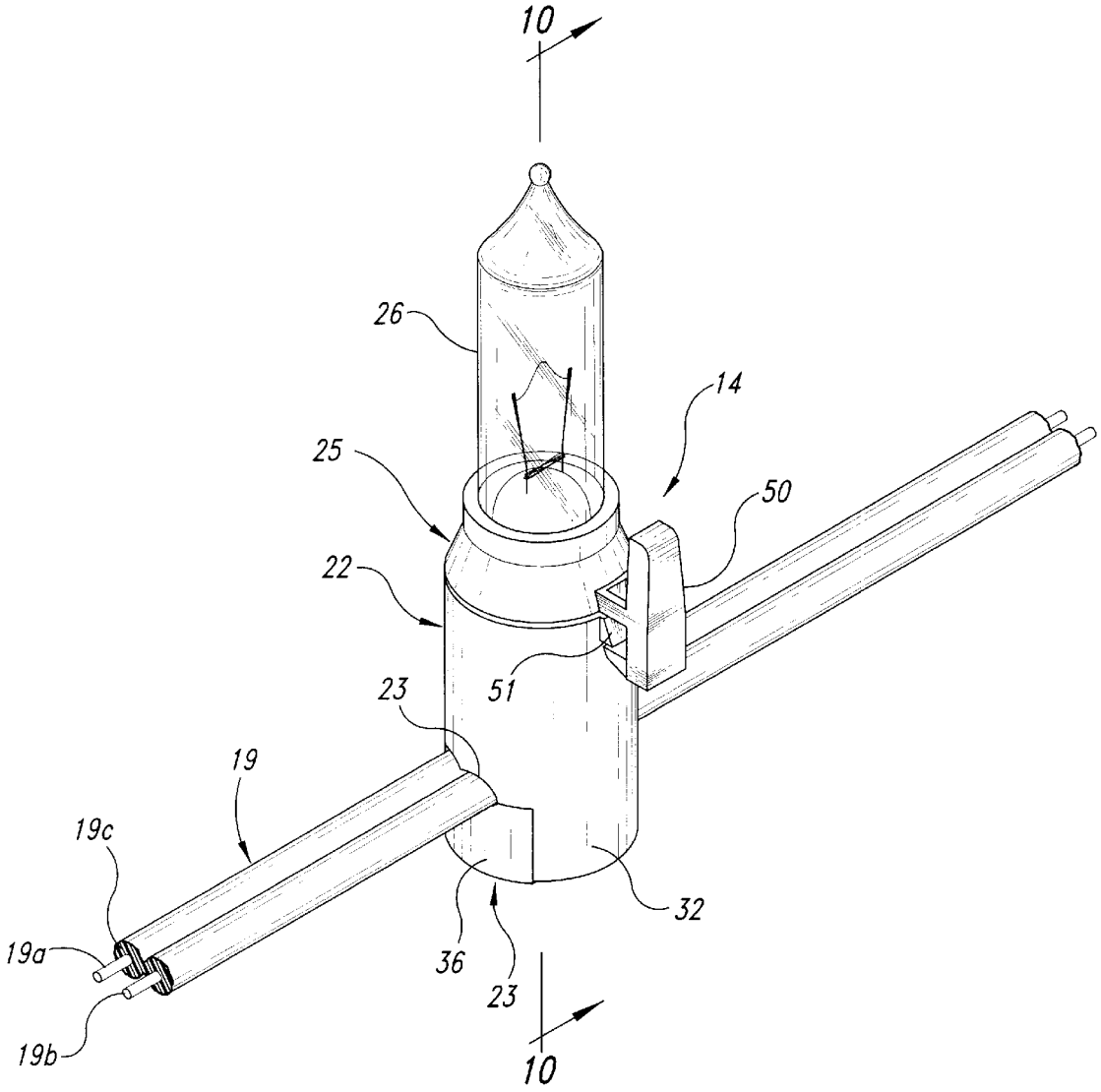
FIG. 8 is a perspective view showing one of the light units.
Figure 9:
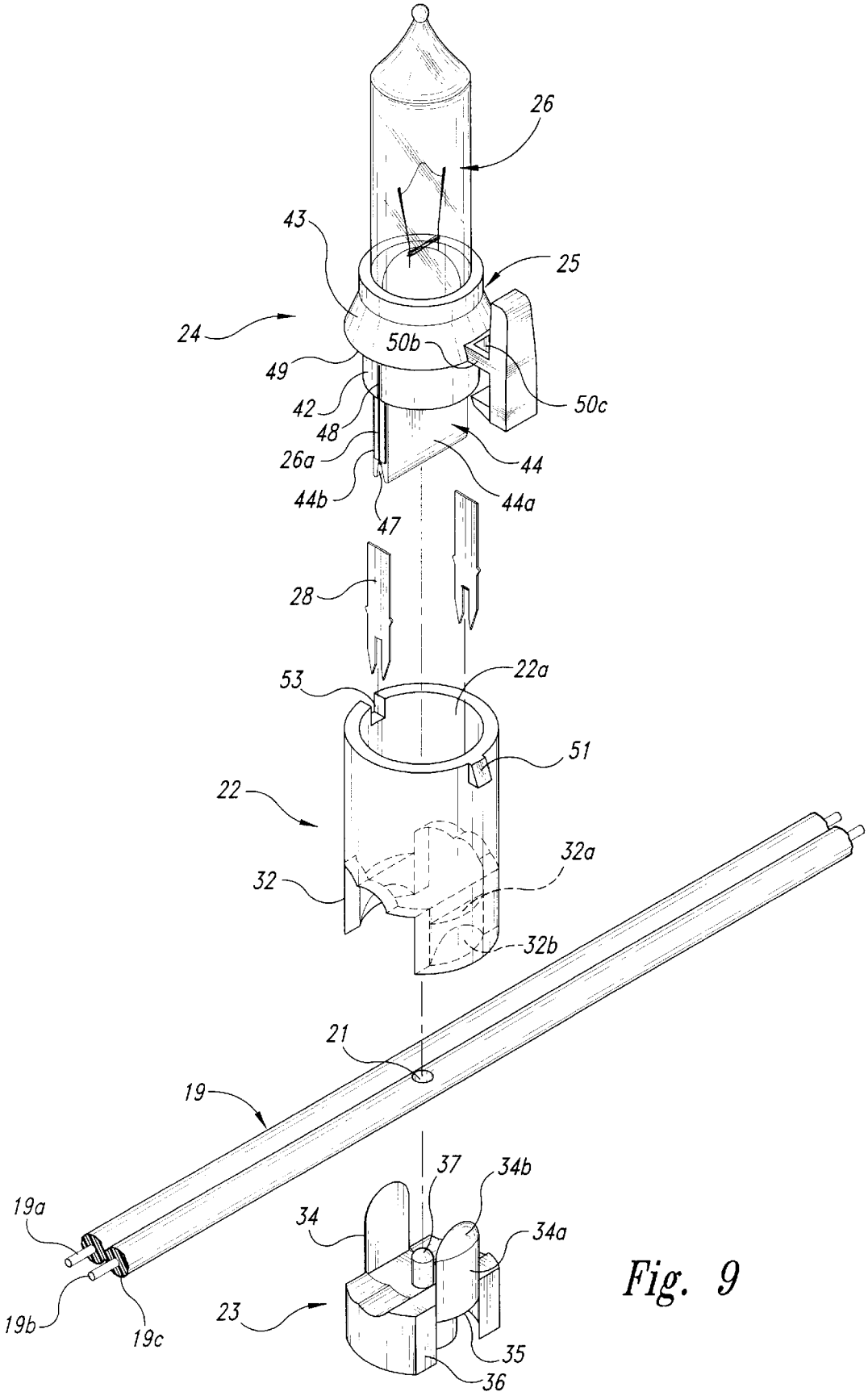
FIG. 9 is an exploded view of one of the light units.
Figure 10:
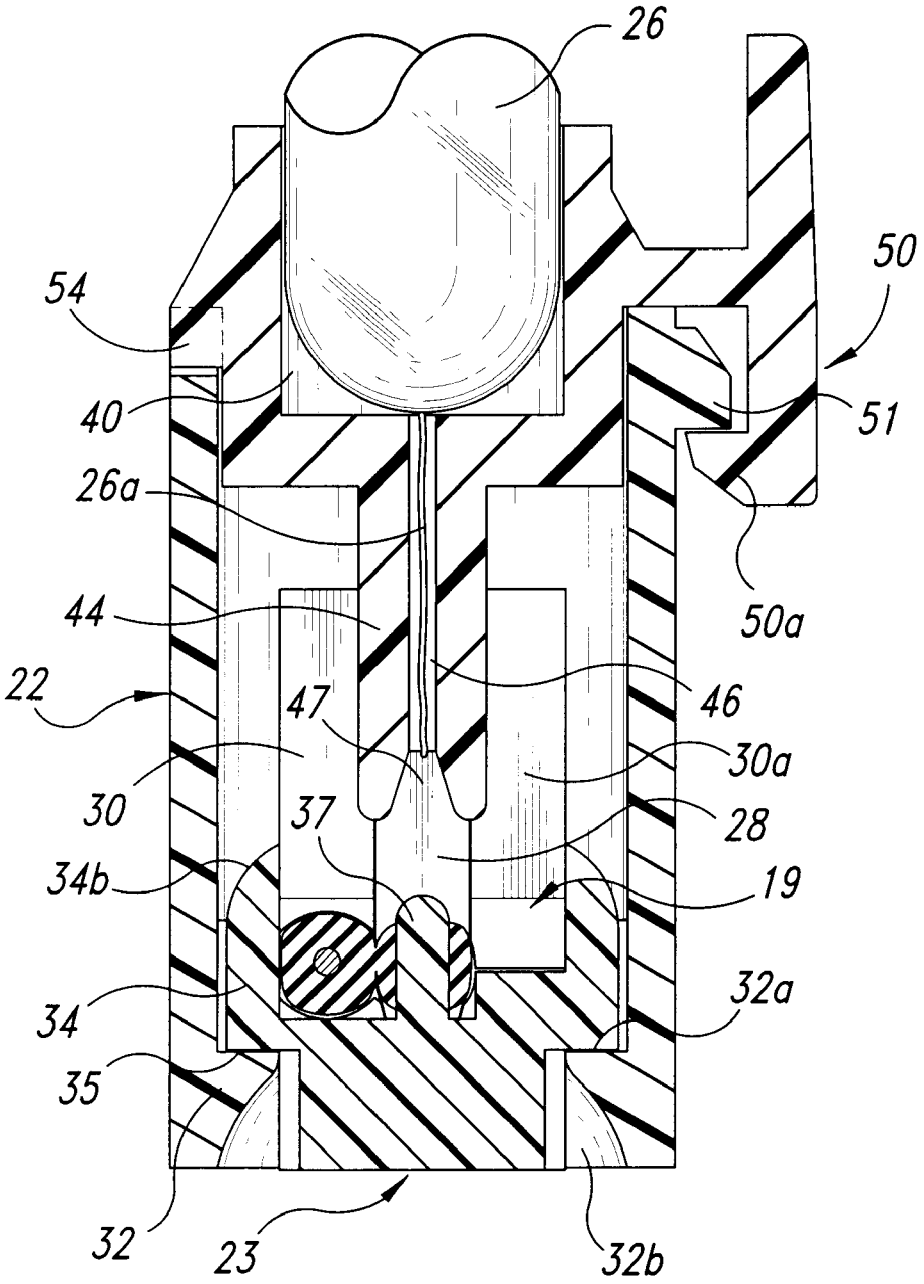
FIG. 10 is a longitudinal vertical sectional view through one of the light units taken as indicated by line 10—10 in FIG. 8.

Referring to FIGS. 8–10, the light units 14 may be, for example, oil the type including an injection-molded two-piece plastic lampholder consisting of a socket unit 22 and a generally U-shaped base unit 23 which have a snap interfit and provide therebetween a wireway 23 for passage of the cord 19. The socket unit 22 provides a generally circular socket cavity 22*a* along the length for receiving a push-in bulb unit 24 having an injection-molded plastic bulb holder 25 in which a bulb 26 with a pair of leads 26*a* from its filaments is mounted. Each lampholder also has a pair of elongated push-in contact elements 28 located in guideways 29 between a respective pair of ribs 30–30*a* at opposite sides of the socket cavity 22*a* and arranged to project into the wireway 20. There the contact elements 28 pierce the insulation of the cord 19 so as to engage the wire 19*b* of the cord on opposite sides of a respective cutout 21 in the wire.

Projecting from the socket unit 22 on opposite sides of the wireway 21 are two locking legs 32 presenting opposed locking shoulders 32*a* adjacent their outer end for interfitting with the base unit 23. These shoulders 32*a* are adjoined by beveled lead-in faces 32*b*. The inner face of each locking leg 32 is transversely concave matching the curvature of the socket cavity 22*a*.

The base unit 23 has a pair of flexible guide fingers 34, 34*a* shaped to engage the lead-in faces 32*b* and be flexed at their root end toward one another responsive to pushing of the base unit 23 and socket housing 22 together from opposite sides of the cord 19 after the base unit 23 has been positioned with the cord 19 straddled by the fingers 34 at the site of the cutout 21. At their root end the fingers 34 have retaining shoulders 35 between curved base flanges 36, 36'. These shoulders 35 are engaged by the locking shoulders 32*a* when the base unit 23 and socket unit 22 are snap-fitted together over the cord 19. The guide fingers are preferably arched transversely to provide each with a convex outer guide face 34*a* complementing the concave inner guide face of the respective locking leg 32, and the free end of each guide finger 34 is preferably rounded and beveled on its convex outer side as indicated at 34*b*. The base unit 23 presents a post 37 arranged between the fingers 34 to project into the cutout 21 in wire 19*a* of the cord 19.

The bulb holder 25 has a central socket 40 to receive the bulb 26. This socket 40 is provided in a round plug 42 having an outwardly flared annular rim 43 spaced above its lower end, and having a relatively narrow extension 44 with opposite exterior flat side faces 44*a* between narrow pinch faces 44*b*. A pair of longitudinal passages 46 extend through the base of the plug 42 and through the length of the extension 44 into a slot 47 located at the free end of the narrow extension and intersecting the narrow faces 44*b*. These narrow faces 44*b* are spaced apart slightly less than the diameter of the socket cavity 22*a* to allow for the bulb leads 26*a* and are aligned with the bottom of positioning grooves 48 which are formed in the plug 42 and extend to an annular shoulder 49 at the base of the flared rim 43. When the bulb 26 is positioned in the bulb holder 25, the lead wires 26*a* extend from the bulb 26 through the passages 46 and outwardly at opposite ends of the slot 47. Then the leads 26*a* double back over the narrow pinch faces 44*b* and part way into the grooves 48. When the bulb unit 24 is pushed into the socket unit 22 the bulb leads 26*a* are pinched between the pinch faces 44*b* and the contact elements 28 to complete a circuit bypassing the respective cutout 21 in the wire 19*a*.

Referring to FIGS. 2–7, to establish the draping configuration for the light set there are provided a plurality of injection-molded plastic clips 16 which receive the cord 19 at the ends of the draping sections 11. The clip 16 has two mating housing shells 51–52 which are hinged together by a thin unitary plastic hinge connection along one longitudinal edge portion 53 and are snap-fitted together at the opposite side by a pair of prongs 54 on shell 51 fitting into openings 55 in the shell 52. The shells 51–52 and hinge connection there between are injection molded as a unit.

Each prong 54 has a beveled overhanging head 54*a* which engages a respective ledge 56 at a step in the outer end of the registering opening 55. When the shells are swung together the tapered heads 54*a* ride over the inner edges of the ledges 56 and cause the prongs 54 to deflect sufficiently to snap-fit into locking engagement with the ledges 56.

The shells 51–52 are shaped to provide a longitudinal wireway 58 therebetween which is centrally intersected by a lateral wireway 59 located between the prongs 54 and provided by registering channels 59*a*, 59*b* provided at the outer end portions of the shells. The longitudinal wireway 58 is formed by registering channels 58*a*, 58*b* presented by the shells. These longitudinal channels may be formed with arcuate grooves 58*c* to interfit with the longitudinal edge portions of cord 19.

At the clip locations at the ends of the draping sections 11 of the cord, the cord is normally bent to form an elbow portion which is then fitted into longitudinal channel 58*a* or 58*b* and the corresponding lateral channel 59*a* or 59*b* when the clip is in open position. When the clip is snapped closed, the elbow of the cord is trapped.

Figure 5:
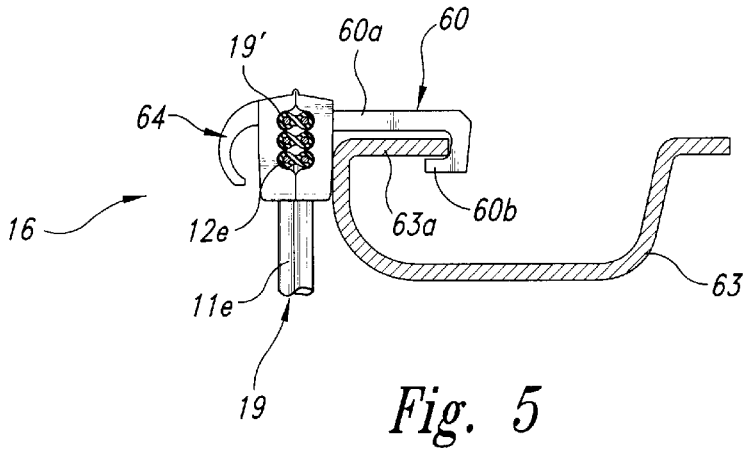
FIG. 5 is an end view of a clip in operative position and taken as indicated by line 5—5 in FIG. 1A.

As shown in FIG. 5, clip 16*f*, for example, has cord 19' and two parts of cord 19 stacked in its longitudinal wireway 58. The bottom one of these two parts bends downwardly within the clip from connecting section 12*c* to draping section 11*c*. Clips 16*b*, 16*c*, 16*g*, 16*j* and 16*k* similarly have their longitudinal wireway occupied by three stacked wire parts, whereas the rest of the clips only contain wire 19 and an elbow portion of cord 19.

The clips 16 are preferably provided with one or two mounting elements for engaging, for example, the outer lip of a roof gutter, or a stretched line or wire mounted preliminarily to support the draping set, or on the heads of nails. The shell 52 may be formed with an outwardly projecting hook 60 having an elongated shank 60*a* extending perpendicular to the outer face of the shell 52 near the hinge end thereof and having a bill 60*b* aimed back at the shell 52. To aid in the injection molding of this bill the shell 52 is provided with a central opening 62 opposite the bill. As shown in FIG. 5, when the hooks 60 are used to mount the draping light string on a plastic or sheet metal roof gutter 63 of the type having an upper lip 63*a* along its outside upper edge, each hook 60 rests with its shank 60*a* on the gutter lip 63*a* and its bill 60*b* engaging the edge of the lip.

Figure 6:
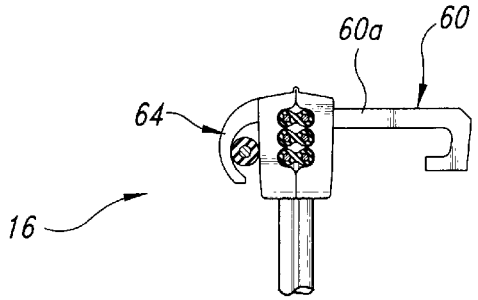
FIG. 6 is an end view of a clip taken as in FIG. 5 but showing the second hook in operation.

An alternative hook 64 may be provided on the outside of the other shell 51 so that the clip can be hung from a line or wire 65 as indicated in FIG. 6. To aid in the injection molding of this hook 64 the shell 51 is preferably provided with a central opening 67. The significance of the openings 62 and 67 can be seen in FIG. 2 which shows the clip as it is when released after being molded in a two-part mold.

Figure 7:
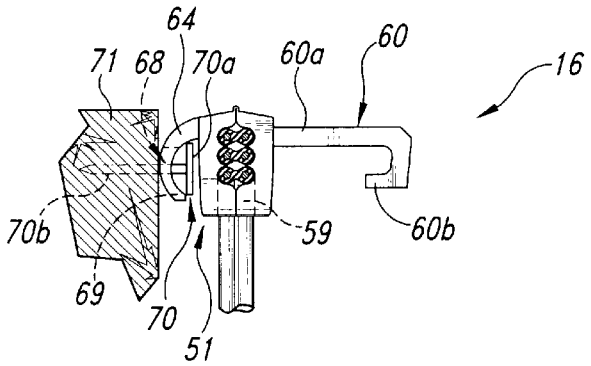
FIG. 7 is an end view of a clip taken as in FIG. 6 but showing an alternative mounting arrangement using the second hook.

To add an alternative mounting function for the hook 64 it may be formed with a pear shaped central opening 68 which widens and then narrows from a slot 69 which bisects the bill of the hook. The opening 68 and slot 69 enable the hook 66 to fit onto the head end portion of a nail 70 projecting from a support 71 as shown in FIG. 7. The halves of the hook 66 on both sides of the slot 69 are flexible enough that they can be sprung apart sufficiently to temporarily widen the slot for passage of nail shanks with a diameter greater than the normal width of the slot 69. The clip is positioned on the nail 70 by lowering the clip so that the head 70*a* of the nail is located between the hook 64 and the outer face of the shell 51. Then the slot 69 gives lateral passage for the nail shank 70*b* to enter the opening 68. A nail 70 is chosen which has a large enough head 70*a* to be retained behind the hook 66. In this regard, the nail head 70*a* can be of a size that the wider lower part of the hook opening 68 can pass over the nail head when the hook is pushed toward the nail head so that the lower part of the hook opening 68 will register with the nail head. Then the clip can be lowered so that the nail head is lodged behind the portions of the hook 64 adjoining the narrower end portion of the hook opening 68.

Returning to FIGS. 1A and 1B, it is seen that the cord 19' for the second draping string 10' extends through the longitudinal wireway 58 of each of the clips 16 for the first string 10, and that the cord 19 from the first string 10 extends through the longitudinal wireway of each of the clips for the second draping string 10'. In the illustrated example, the cord 19 passes from the plug 17 to the longitudinal wireway 58 of the first clip 16*a* wherein it bends downwardly at an elbow to exit through the other wireway 59 to start the longest drape section 11*a*. This section terminates at clip 16*b* which it enters from the bottom through wireway 59 and exits to the left through wireway 58 as the beginning of connecting section 12*a*. The latter in turn enters the left end of wireway 58 of clip 16*c* and bends downwardly through its wireway 59 to start draping section 11*b*. This in turn extends to clip 16*d* which it enters from the bottom and exits to the right as connecting section 12*b*. The latter extends to clip 16*e* to start draping section 11*c* which continues to clip 16*f* to start connecting section 12*c*. The same procedure continues to form draping section 11*d*, connecting section 12*d*, draping section 11*c*, connecting section 12*e*, and the shortest draping section 11*f* which extends between clips 16*k* and 16*l*. At the latter clip the cord 19 exits to the right and then passes together with cord 19' through the longitudinal wireways of clips 16*k*, 16*j*, 16*g*, 16*f*, 16*c*, and 16*b* in the recited order. Then the cord 19 passes through the longitudinal wireways 58 of all of the clips in the second string 10', and the cord 19' repeats in the second string the same pattern of alternating draping sections and connecting sections made by cord 19 as previously described respecting the first string 10. Then the cord 19' terminates at the add-on plug 18 together with the cord 19.

It will be appreciated that rather than having dual draping strings sharing a wall plug and add-on plug as shown and described, a single draping string can be provided. In other words string 10 can have an add-on plug at its end and cord 19' be eliminated from its extension across the top of string 10. With this alternative arrangement several of the single draping strings 10 an be plugged together in series. Furthermore, the number of draping sections provided by each string can be varied, and the clips 16 can be modified to have only one supporting or hanging element.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. A draping light set comprising:

an electric wire unit having two insulated wires arranged in a plurality of progressively longer draping sections which drape in vertically spaced arcs from respective pairs of attachments located at the ends of the draping sections, said two insulated wires having connecting sections interconnecting said draping sections at said attachments with each connecting sections extending between a respective two of said attachments which are in different ones of said pairs of attachments;

and a plurality of lights attached to said draping sections and making an electrical series connection with one of said wires.

2. A draping light set according to claim 1 in which said attachments are support on an insulated wire cord which extends along side of said connecting sections.

3. A draping set according to claim 1 in which said attachments are clips which have a first wireway aligned with said connecting sections and have a second wireway at a cross-angle to said first wireway so that said cord can be bent to an elbow at the juncture of a connecting section and the adjoining draping section and have said elbow located with the connecting section portion thereof in said first wireway and the draping section portion thereof in said second wireway.

4. A draping light set according to claim 3 in which said clip has two body parts hinged together at a hinge axis parallel to said first wireway and jointly providing said wireways when the clip is in a closed position;

said clip having an open position in which said wireways are spread open for introduction of a said elbow, and has a closed position in which said elbow is held by said clip parts in said wireways.

5. A draping light set according to claim 4 in which said clip parts have a snap-type interfit when said clip is in a closed position, said interfit being located on the opposite side of said first wireway from said hinge axis.

6. A draping light assembly comprising:

first and second light sets arranged in end to end relation and having respective first and second electric wire units each connected at a first end to a plug and having a second end;

each of said wire units having two insulated wires arranged in a plurality of progressively longer draping sections which are separated by connecting sections and drape in vertically spaced arcs from clips located at the junctures of said draping and connecting sections;

a plurality of lights operatively attached to said draping sections;

said second wire unit being carried from said plug to said second set along the top of said first set by the clips in said first set, and said first wire unit being carried from said first set to said second end by the clips in said second set.

7. A draping light assembly according to claim 6 in which said second end of the wire units are mounted in an add-on socket.

8. A draping light set comprising:

an electric wire assembly having two insulated wires arranged in progressively longer draping sections, which drape in vertically spaced arcs from supporting elements located at the ends of the draping sections, said arcs having central portions which are aligned; and a plurality of light bulbs in each are electrically connected in series to one of said two insulated wires.

9. A draping light set according to claim 8 in which said supporting elements interact with a top insulated wire.

10. A draping light unit comprising:

an electrical wiring circuit including a top wire portion and a draping wire portion electrically connected together, said draping wire portion depending from said top wire portion in the form of at least two continuous vertically spaced arcs having different lengths and vertically aligned central portion; and a plurality of lights connected in series to said draping wire portion, there being multiple of said lights in each of said arcs.

11. A draping light assembly comprising:

an electrical plug;

insulated wire circuitry extending from said plug including insulated top wires and including a draping unit;

said draping unit having two insulated wires arranged together in at least two continuous arcs having different lengths and draping downwardly, one directly above the other, to different levels, each end of said arcs being hung from at least one of said top wires; and a respective plurality of light bulbs in each of said arcs, each of said bulbs having a pair of leads, and one of said two insulated wires being continuous and the other one of said two insulated wires being interrupted at each of said and making electrical connection with said leads for each bulb to connect all of the bulbs in each draping unit in series.

12. A draping light assembly comprising:

first and second side-by-side draping assemblies each continuing from a respective top wire section, and having a draping wire section, each of said draping wire sections being in the form of at least two continuous vertically spaced arcs having different lengths and vertically aligned central portion, the ends of said arcs being supported from one of said top wire sections; and a respective plurality of lights connected in series to said draping wire sections, there being multiple of said lights in each of said arcs.

13. A draping light assembly comprising:

an electrical plug;

insulated wire circuitry extending from said plug including insulated top wires and including first and second draping units positioned side-by-side;

each of said draping units having two insulated wires arranged together in at least two continuous arcs having different lengths and draping downwardly, one directly above the other, to different levels, each end of said arcs being hung from at least one of said top wires; and a respective plurality of light bulbs in each of said arcs, each of said bulbs having a pair of leads, and one of said two insulated wires in each of said draping units being continuous and the other one of said two insulated wires being interrupted at each of said bulbs and making electrical connection with said leads for each bulb to connect all of the bulbs in each draping unit in series.

14. A draping light assembly according to claim 13 in which said arcs are hung by clips from said top wires.

* * * * *

UNITED STATES PATENT AND TRADEMARK OFFICE

CERTIFICATE OF CORRECTION

PATENT NO : 6,155,697
DATED : December 5, 2000
INVENTOR(S) : Joseph M. Ahroni

It is certified that errors appear in the above-identified patent and that said Letters Patent are hereby corrected as shown below:

Claim 8, column 6, line 29 "portions which are aligned;" should read --portions which are vertically aligned;--.
Claim 8, column 6, line 30, "in each are electrically" should read --in each arc electrically--.
Claim 10, column 6, line 42 "central portion; and" should read --central portions; and--.
Claim 11, column 6, line 61 "each of said and making" should read --each of said bulbs and making--.
Claim 12, column 7, line 4 "central portion, the ends" should read --central portions, the ends--.
Page 1, column 2, line 29 "example, oil the type" should read --example, of the type--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*